US009138637B1

(12) United States Patent
Adams

(10) Patent No.: US 9,138,637 B1
(45) Date of Patent: Sep. 22, 2015

(54) RANDOMIZED ANSWER GENERATOR TOY

(71) Applicant: David G. Adams, Lindon, UT (US)

(72) Inventor: David G. Adams, Lindon, UT (US)

( * ) Notice: Subject to any disclaimer, the term of this patent is extended or adjusted under 35 U.S.C. 154(b) by 0 days.

(21) Appl. No.: 14/277,501

(22) Filed: May 14, 2014

(51) Int. Cl.
*A63F 9/24* (2006.01)
*A63F 9/18* (2006.01)
*A63F 11/00* (2006.01)

(52) U.S. Cl.
CPC ..... *A63F 9/181* (2013.01); *A63F 9/183* (2013.01); *A63F 11/0011* (2013.01)

(58) Field of Classification Search
CPC ... A63F 9/0406; A63F 9/0468; A63F 9/0495; A63F 2009/0493; A63F 11/0011; A63F 9/181; A63F 9/183
USPC ..... 273/138.2, 138.5, 145 R, 145 C, 144 R, 273/457, 161, 143 R, 138.1, 459, 460; 463/22, 20
See application file for complete search history.

(56) References Cited

U.S. PATENT DOCUMENTS

| | | | | |
|---|---|---|---|---|
| 5,482,277 | A | 1/1996 | Young | |
| 5,775,997 | A | 7/1998 | Veatch | |
| 6,273,421 | B1 | 8/2001 | Thalheimer | |
| D638,071 | S * | 5/2011 | Tyler | D21/372 |
| 2012/0211940 | A1 * | 8/2012 | Schneider | 273/138.2 |

* cited by examiner

*Primary Examiner* — Eugene Kim
(74) *Attorney, Agent, or Firm* — Crossley Patent Law

(57) ABSTRACT

An apparatus for a randomized answer generator toy having a spherical and alternately a substantially prolate spheroid shaped housing. The housing has an outer perimeter and an inner chamber. A transparent display window and a push button is disposed upon the housing. A stitching and alternately a groove is disposed upon the outer perimeter and is configured to increase a user's grip about the toy. A randomizer mechanism is disposed within the inner chamber. An answer display having a plurality of predefined answer images is disposed on the randomizer mechanism. Each of the push button, the randomizer mechanism, and the answer display are in operational communication. The answer display is activated upon depression of the push button. Wherein, one of the answer images is positioned in the inner chamber proximal the display window upon activation of the answer display and is visible through the transparent display window.

6 Claims, 3 Drawing Sheets

RANDOMIZED ANSWER GENERATOR TOY

BACKGROUND OF THE INVENTION

Various types of apparatus for a randomized answer generator toy are known in the prior art. However, many of these toys lack a push button allowing for the quick generation of a randomized answer display. Also, a common problem with the prior art is that user's hands become sweaty and can no longer grip the toy sufficiently to continue play. These prior art toys lack stitching or a groove to increase the users grip about the toy, allowing the user to play with the toy even when their hands are sweaty.

Thus, what is needed is a randomized answer generator toy. The present apparatus for a randomized answer generator toy has a substantially spherical and alternately a substantially prolate spheroid shaped housing. The housing has an outer perimeter and an inner chamber. A transparent display window and a push button is disposed upon the housing. A stitching and alternately a groove is disposed upon the outer perimeter and is configured to increase a user's grip about the toy. A randomizer mechanism is disposed within the inner chamber. An answer display having a plurality of predefined answer images is disposed on the randomizer mechanism. Each of the push button, the randomizer mechanism, and the answer display are in operational communication. The answer display is activated upon depression of the push button. Wherein, one of the answer images is positioned in the inner chamber proximal the display window upon activation of the answer display and is visible through the transparent display window.

FIELD OF THE INVENTION

The present invention relates generally to a toy apparatus, and more particularly, to a randomized answer generator toy.

SUMMARY OF THE INVENTION

The general purpose of the present randomized answer generator toy, described subsequently in greater detail, is to provide a randomized answer generator toy which has many novel features that result in a randomized answer generator toy which is not anticipated, rendered obvious, suggested, or even implied by prior art, either alone or in combination thereof.

The apparatus for a randomized answer generator toy includes a housing having an inner chamber and an outer perimeter. Stitching is disposed upon the outer perimeter of the housing. The stitching is configured to increase a user's grip upon the apparatus. Wherein, the stitching improves a user's ability to hold the apparatus and to toss the apparatus to other players. The housing can be substantially spherical as shown in FIGS. 1-4. FIGS. 1-3 show that stitching can have a shape substantially shaped as the stitching of a baseball.

Alternately, the housing can be substantially prolate spheroid shaped as illustrated in FIG. 5. FIG. 5 illustrates an alternative embodiment showing that the stitching can have a shape substantially shaped as the stitching of a football.

An alternate embodiment includes a housing having an substantially spherical shape and a groove (not illustrated), wherein the groove has a shape. Wherein, the shape of the groove is selected from the group consisting of basketball shaped groove, tennis ball shaped groove, and soccer ball shaped groove.

Both the groove and the stitching serve the function of increasing the user's ability to grasp the toy by increasing the contact surface area of the toy, and thereby increasing the coefficient of friction experienced by the user upon the outer perimeter of the toy whilst grasping the toy with the user's hand. Additionally, the stitching and the groove both serve to enhance play by improving a user's ability to throw and alternately catch the toy, based upon the increased frictional forces defined by each of the stitching and the groove.

A transparent display window is disposed upon the outer perimeter of the housing. The transparent display window is illustrated as being circular, however differently shaped display windows are envisioned, such as those having substantially square, rectangular, triangular, or polygonal shapes. A push button is also disposed on the outer perimeter. The push button is configured to depress upon a pressure from a user. The push button can include any logo of the user or manufacturer's choice.

A randomizer mechanism is disposed within the inner chamber. The randomizer mechanism is in operational communication with the push button. A plurality of randomizer mechanisms can be appreciated by a person having skill in the art, such as wheel based randomizer spinner mechanisms whereby randomization of the answer display is based upon the amount of force exerted upon the push button, as well as flip hinge based randomizer mechanisms, whereby randomization of the answer display is based upon the amount of force exerted upon the push button. An answer display is disposed upon the randomizer mechanism. The answer display is in operational communication with the randomizer mechanism. The answer display has a plurality of answer images. The answer display is configured to display a random answer image through the transparent display window upon depression of the push button. The answer image is determined randomly by the randomizer mechanism based upon the parameters previously defined.

The randomizer mechanism is activated upon depression of the push button. The answer display is activated upon activation of the randomizer mechanism. Wherein, one of the answer images is positioned in the inner chamber proximal the display window upon activation of the answer display and is visible through the transparent display window.

Thus has been broadly outlined the more important features of the present randomized answer generator toy so that the detailed description thereof that follows may be better understood and in order that the present contribution to the art may be better appreciated.

Numerous objects, features and advantages of the present randomized answer generator toy will be readily apparent to those of ordinary skill in the art upon reading the following detailed description of presently preferred, but nonetheless illustrative, examples of the present randomized answer generator toy when taken in conjunction with the accompanying drawings.

BRIEF DESCRIPTION OF THE DRAWINGS

Figures

DETAILED DESCRIPTION OF THE DRAWINGS

With reference now to the drawings, and in particular FIGS. 1 through 5 thereof, the instant randomized answer generator toy employing the principles and concepts of the present randomized answer generator toy and generally designated by the reference number 10 will be described.

Figure 1:
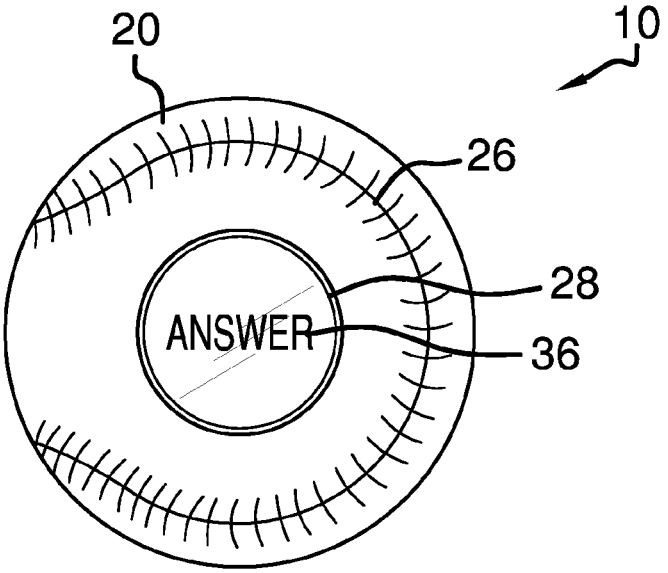
FIG. 1 is a front view.
Figure 2:
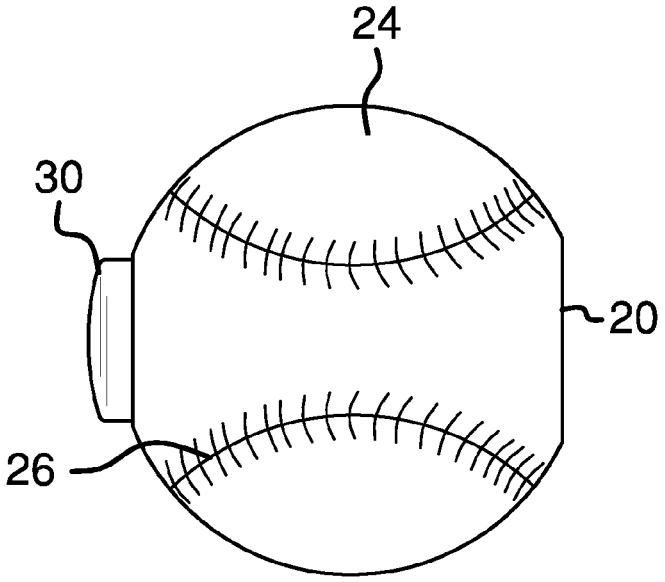
FIG. 2 is a side view.
Figure 3:
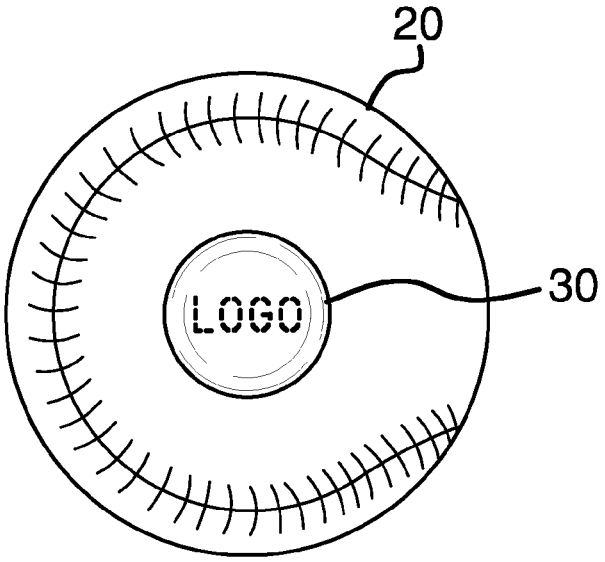
FIG. 3 is a back view.
Figure 4:
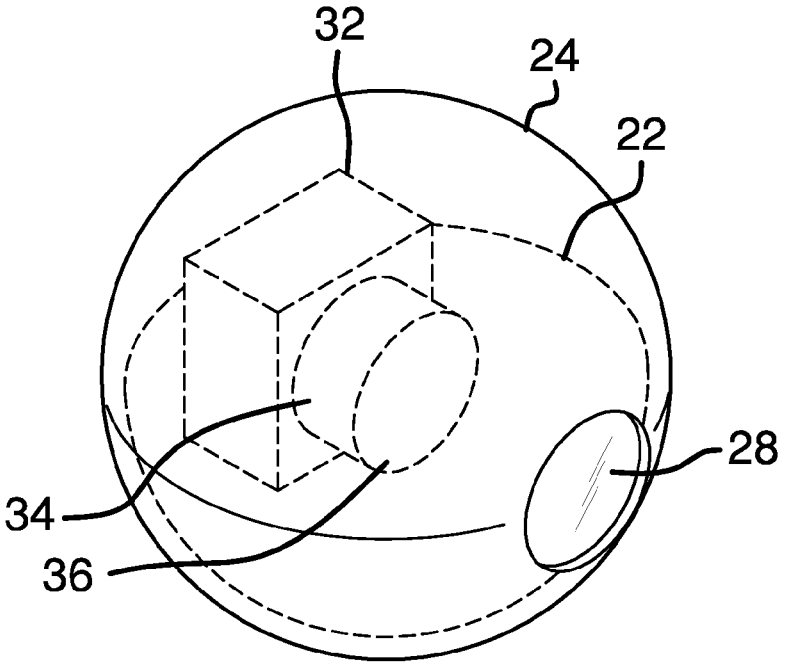
FIG. 4 is a detail view.

Referring to FIGS. 1 through 5 a preferred embodiment of the present randomized answer generator toy 10 is illustrated. The apparatus for a randomized answer generator toy includes a housing 20 having an inner chamber 22 and an outer perimeter 24. Stitching 26 is disposed upon the outer perimeter 24 of the housing 20. The stitching 26 is configured to increase a user's grip upon the apparatus. Wherein, the stitching 26 improves a user's ability to hold the apparatus and to toss the apparatus to other players. The housing 20 can be substantially spherical as shown in FIGS. 1-4. FIGS. 1-3 show that stitching 26 can have a shape substantially shaped as the stitching of a baseball.

Figure 5:
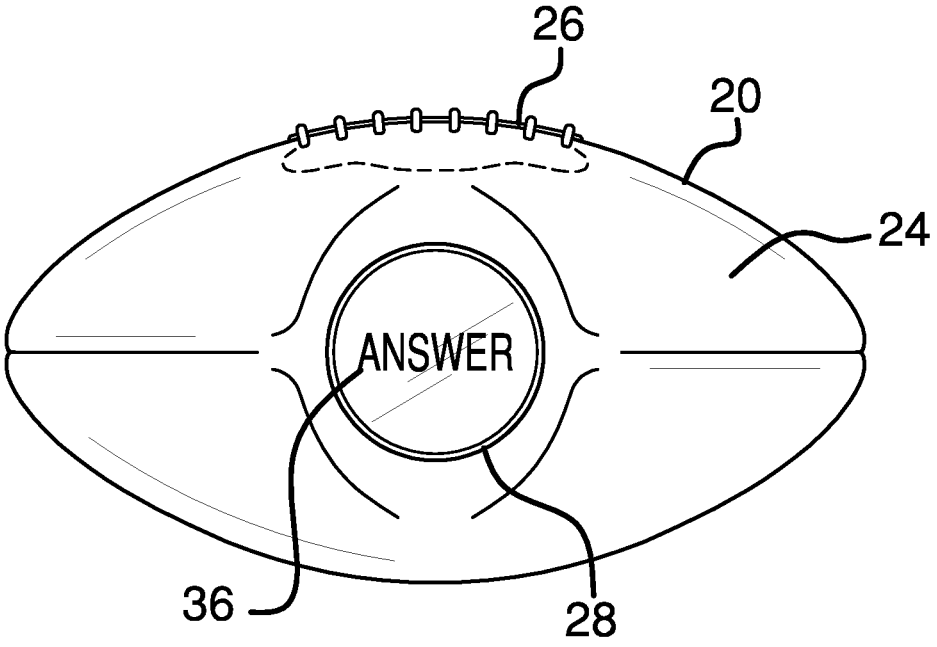
FIG. 5 is a front view of an alternate embodiment.

Alternately, the housing 20 can be substantially prolate spheroid shaped as illustrated in FIG. 5. FIG. 5 illustrates an alternative embodiment showing that the stitching 26 can have a shape substantially shaped as the stitching of a football.

An alternate embodiment includes a housing 20 having an substantially spherical shape and a groove (not illustrated), wherein the groove has a shape. Wherein, the shape of the groove is selected from the group consisting of basketball shaped groove, tennis ball shaped groove, and soccer ball shaped groove.

A transparent display window 28 is disposed upon the outer perimeter 24 of the housing 20. The transparent display window 28 is illustrated as being circular, however differently shaped display windows are envisioned, such as those having substantially square, rectangular, triangular, or polygonal shapes. A push button 30 is also disposed on the outer perimeter 24. The push button 30 is configured to depress upon a pressure from a user.

A randomizer mechanism 32 is disposed within the inner chamber 22. The randomizer mechanism 32 is in operational communication with the push button 30. An answer display 34 is disposed upon the randomizer mechanism 32. The answer display 34 is in operational communication with the randomizer mechanism 32. The answer display 34 has a plurality of answer images 36.

The randomizer mechanism 32 is activated upon depression of the push button 30. The answer display 34 is activated upon activation of the randomizer mechanism 32. Wherein, one of the answer images 36 is positioned in the inner chamber 22 proximal the display window 28 upon activation of the answer display 34 and is visible through the transparent display window 28.

What is claimed is:

1. A randomized answer generator toy comprising:

a housing having an inner chamber and an outer perimeter;

a transparent display window disposed upon the outer perimeter;

a push button disposed on the outer perimeter, the push button configured to depress upon a pressure from a user;

a randomizer mechanism disposed within the inner chamber, the randomizer mechanism in operational communication with the push button; and an answer display disposed upon the randomizer mechanism, the answer display in operational communication with the randomizer mechanism, the answer display having a plurality of answer images;

wherein the randomizer mechanism is immediately activated only upon depression of the push button;

wherein the answer display is immediately activated upon only activation of the randomizer mechanism; and wherein one of the answer images is positioned in the inner chamber proximal the display window upon activation of the answer display, the answer.

2. The randomized answer generator toy of claim 1 wherein the housing is substantially spherical.

3. The randomized answer generator toy of claim 1 wherein the housing is substantially prolate spheroid shaped.

4. The randomized answer generator toy of claim 2 further comprising:

a stitching disposed upon the outer perimeter, the stitching substantially shaped as the stitching of a baseball.

5. The randomized answer generator toy of claim 2 further comprising:

a groove disposed upon the outer perimeter, the groove having a shape;

wherein the shape of the groove is selected from the group consisting of basketball shaped groove, tennis ball shaped groove, and soccer ball shaped groove.

6. The randomized answer generator toy of claim 3 further comprising:

a stitching disposed upon the outer perimeter, the stitching substantially shaped as the stitching of a football.

* * * * *